United States Patent [19]

Baracz

[11] 4,160,416

[45] Jul. 10, 1979

[54] PROGRAMMED SELF-DESTRUCT SYSTEM FOR A MUNITION

[75] Inventor: Andrew J. Baracz, Sparta, N.J.

[73] Assignee: The United States of America as represented by the Secretary of the Army, Washington, D.C.

[21] Appl. No.: 898,050

[22] Filed: Apr. 20, 1978

[51] Int. Cl.[2] ..... F42C 11/06

[52] U.S. Cl. ..... 102/215

[58] Field of Search ..... 102/215, 209, 207, 206

[56] References Cited

U.S. PATENT DOCUMENTS

| | | | |
|---|---|---|---|
| 3,622,987 | 11/1971 | Borkan | 102/215 |
| 3,646,371 | 2/1972 | Flad | 102/215 |
| 3,760,732 | 9/1973 | Schuster et al. | 102/215 |
| 3,967,554 | 7/1976 | Troyer, Jr. | 102/215 |
| 4,116,133 | 9/1978 | Beuchat | 102/215 |

*Primary Examiner*—Charles T. Jordan

*Attorney, Agent, or Firm*—Nathan Edelberg; A. Victor Erkkila; Max Yarmovsky

[57] ABSTRACT

A device for electromagnetically encoding an energy passive munition prior to launch. A high frequency (HF) external energy source charges a first rectifier-capacitance circuit, having a relatively long time constant, via a secondary receiving coil. The first rectifier-capacitance circuit acts as a temporary power source for energizing programming circuitry capable of receiving subsequently pulsed HF encoding signals. A second rectifier-capacitor circuit, having a shorter time constant, is used to energize logic circuitry for programming a nonvolatile memory in binary coded bits. The binary code information is used to set a timer which subsequently causes the munition to self-destruct after launch in a time period in accordance with encoded signals stored in a memory.

5 Claims, 8 Drawing Figures

PROGRAMMED SELF-DESTRUCT SYSTEM FOR A MUNITION

GOVERNMENTAL INTEREST

The invention described herein may be manufactured, used and licensed by or for the Government for governmental purposes without the payment to me of any royalty thereon.

BACKGROUND OF THE INVENTION

Various means have been used in the prior art to arm a munition during the launching or deployment operation. One of the means for accomplishing this electrically was to induce a short high frequency pulse by electro-magnetic coupling into the munitions' internal arming circuitry. Usually the high frequency pulse had to have sufficient energy to blow wire links which then programmed and actuated the munition. Frequently the programming was accomplished by controlling the amplitude of the HF pulse. However, due to the limited resolution of such systems the number of instructions were limited to only two. Another problem with some of the prior art arming devices was that they frequently attempted to combine the programming and activation operations during the launch period. The combined operations during launch limited the available time to deliver programming instructions and usually prevented last minute change in setting. Another problem with the prior art devices was that the energy transferred by electro-magnetic coupling could not be accurately delivered because of varying mechanical tolerances and differences in the properties of the magnetic materials surrounding and bridging the inductive working gap. A further problem with prior art devices using wire links for fuzing was the fact that the link burn out action followed an exponential curve requiring precisely defined amounts of energy to be delivered to the links for consistent results. The combination of limited time for programming, variations in mechanical tolerances and magnetic properties, and the need for precisely defined amounts of energy tended to produce an arming system during launch which was unreliable.

SUMMARY OF THE INVENTION

The present invention relates to a system for electromagnetically encoding an energy passive munition prior to deployment and enabling it to self-destruct in accordance with encoded instructions a specific interval of time after deployment.

An object of the present invention is to provide a munition with the capability of being easily reprogrammed and reused in case of change of task or abandonment of mission.

Another object of the present invention is to provide a programmed self-destruct system for an energy passive munition where there is no restrictions as to the time or location of the prelaunch programming operation.

Another object of the present invention is to provide an energy passive munition with an encoding system which can be electro-magnetically preprogrammed with a plurality of instructions.

Another object of the present invention is to provide an energy passive munition with electromagnetically programming prior to launch wherein dimensional tolerances between a transmitter primary coil and the secondary reciever coil are not critical in order to attain reliability.

A further object of the present invention is to provide an energy passive munition with electromagnetically programmed capability prior to launch which is relatively immune to electronic countermeasures.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
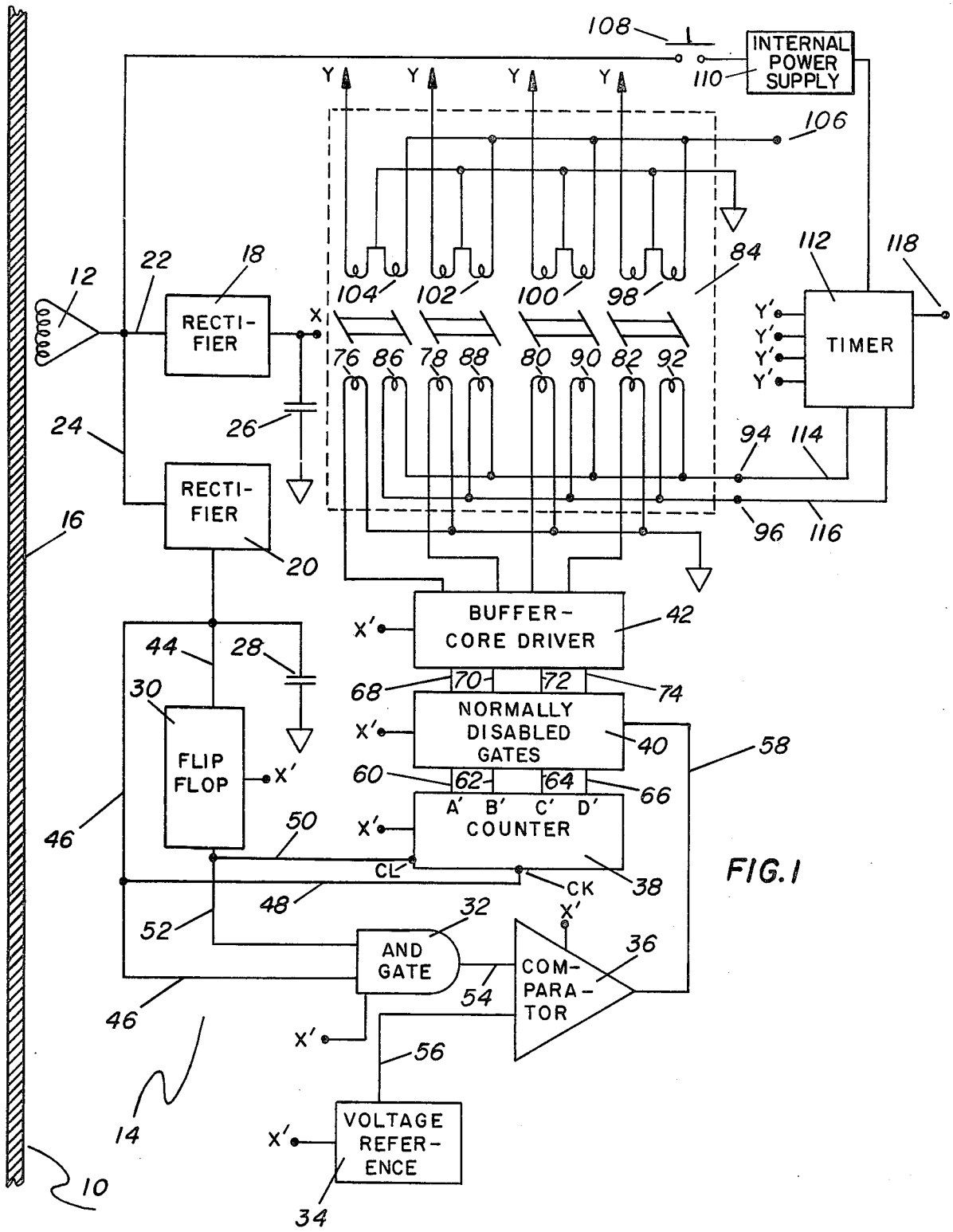
FIG. 1 is a block diagram and partial cross-sectional view of the electromagnetically encoding system for a spin launched munition.
Figure 2:
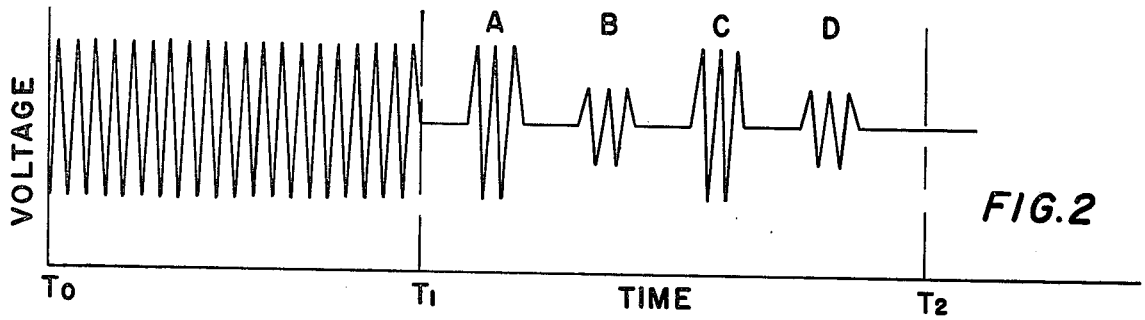
FIG. 2 is a plot of the high frequency voltage as a function of time for the voltage impressed on the secondary receiving coil.
Figure 3:
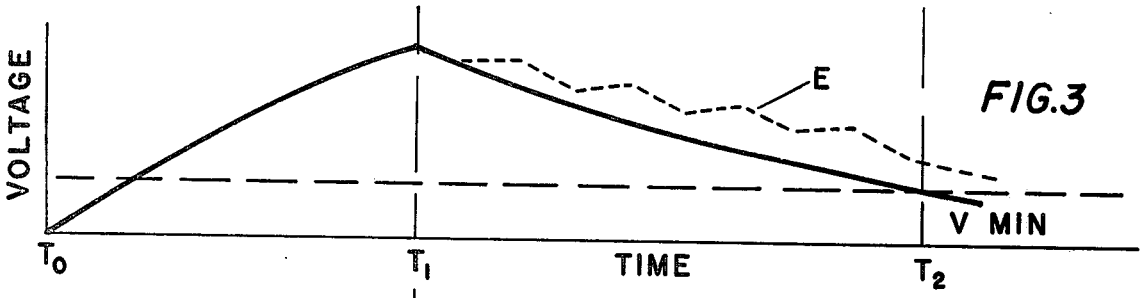
FIG. 3 is a plot of the voltage charge at the output of the first rectifier-capacitance circuit as a function of time.
Figure 4:
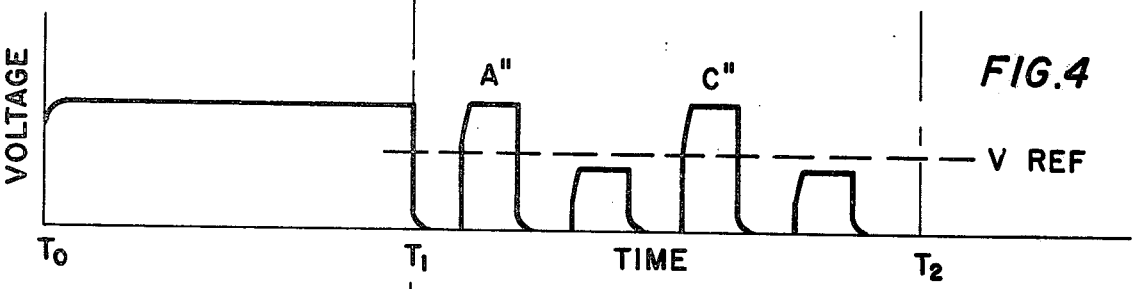
FIG. 4 is a plot of the voltage charge at the output of the second rectifier-capacitance circuit as a function of time.
Figure 5:
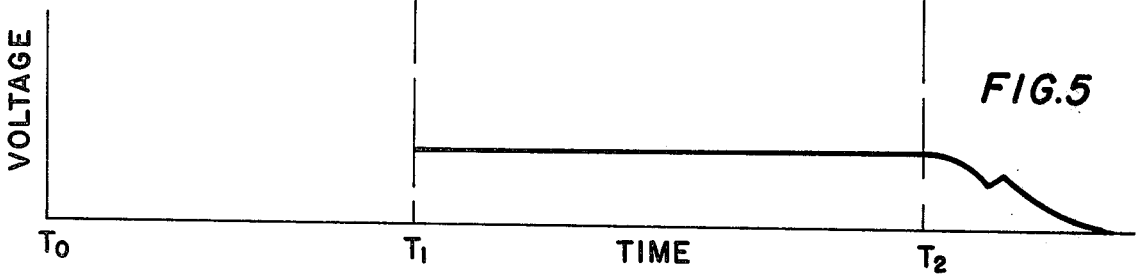
FIG. 5 is a plot of the output voltage of a flip-flop circuit element as a function of time.
Figure 6:
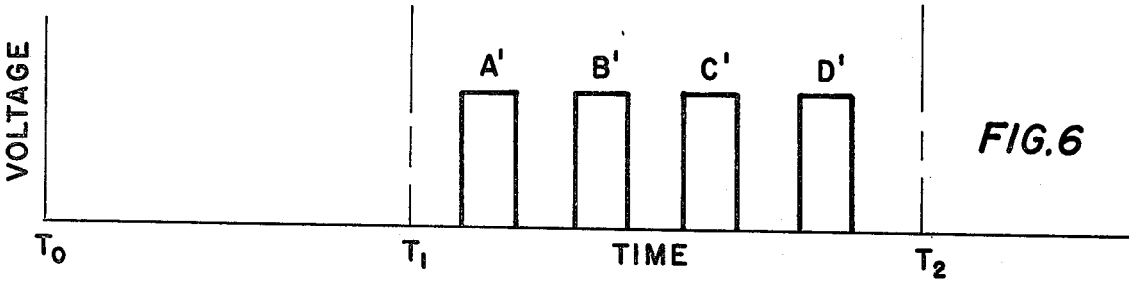
FIG. 6 is a plot of the output voltage pulses of a counter circuit element as a function of time.
Figure 7:
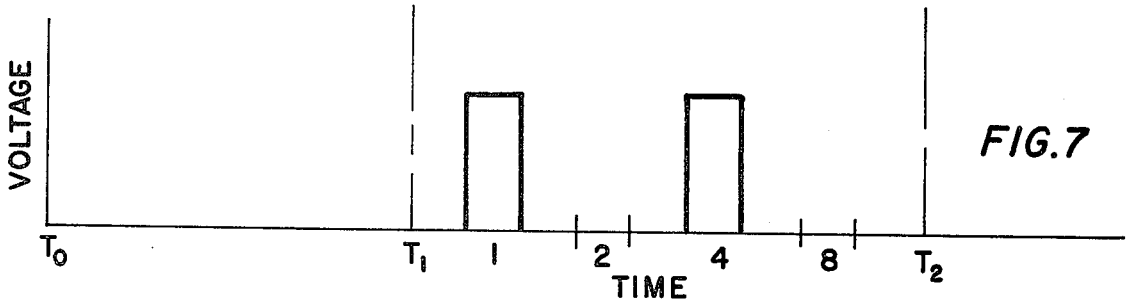
FIG. 7 is a plot of the output voltage encoding pulser of a gate circuit element as a function of time.
Figure 8:
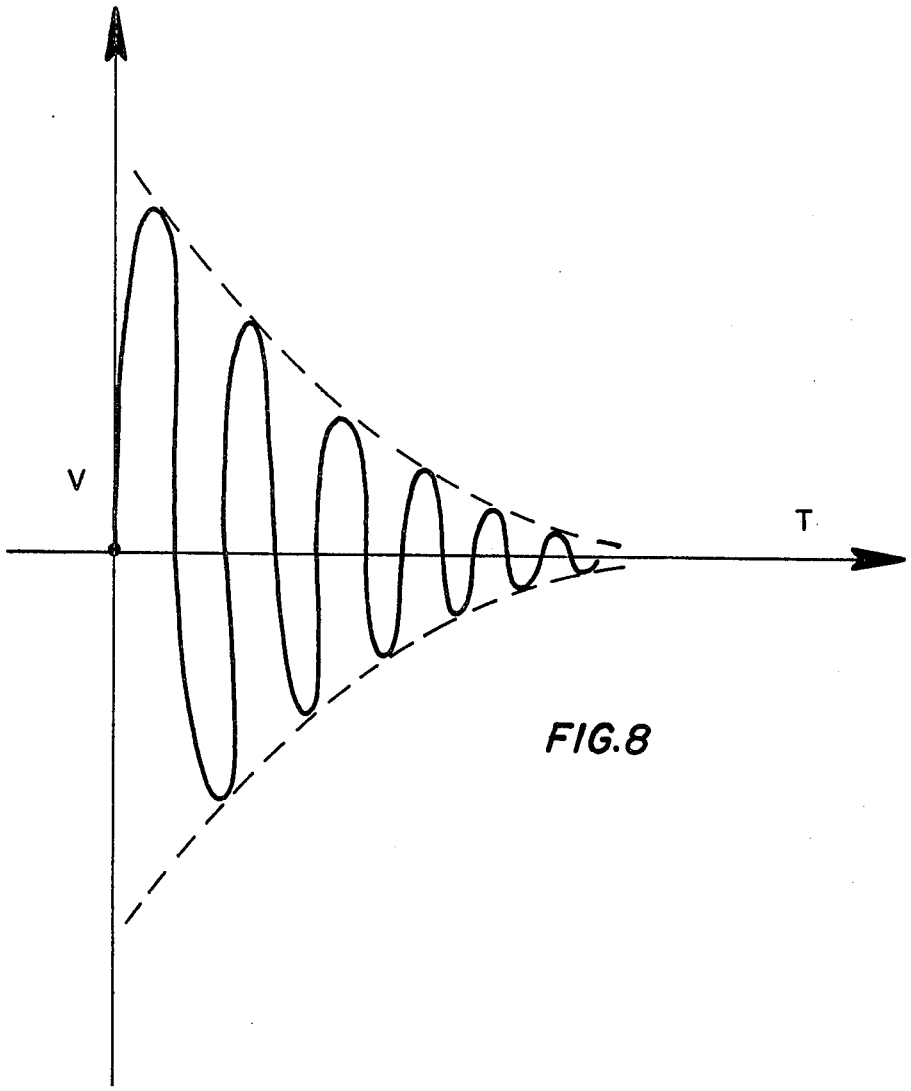
FIG. 8 is a plot of an exponentially decaying demagnetizing wave train as a function of time applied to the magnetic cores of a memory.

Referring now to FIGS. 1–7, munition 10 has a secondary receiving coil 12 of a programmed self-destruct system 14 proximately positioned adjacent to an interior munition wall 16 so that it can easily pick up high frequency signals from an external signalling source not shown. Signals induced in coil 12, prior to launch, occuring during interval of time $t_0$–$t_1$ as shown on FIG. 2, is called the charging period. Signals induced in secondary receiving coil 12 during the period prior to launch between time $t_1$ and $t_2$ is called the programming period. During the charging period $t_0$–$t_1$ a steady high frequency signal is induced in secondary receiving coil 12. The output of receiving coil 12 is fed into first and second rectifiers 18 and 20 via electrical conductors 22 and 24 respectively. The output of rectifiers 18 and 20 charges first and second capacitors 26 and 28 respectively. The charging voltage curves during the period $t_0$–$t_1$ for capacitors 26 and 28 are shown in FIGS. 3 and 4 respectively. The charge stored in first capacitor 26 during the charging period, available at terminal "x", provides the necessary power to energize flip-flop 30, "and" gate 32, voltage reference 34, comparator 36, normally disabled gates 40 and buffer-core drivers 42 via input terminals x' to each of the aforementioned components as shown in FIG. 1. From the charging voltage curves of FIGS. 3 and 4 it can be seen that the time constant of second capacitor 28 has been chosen to make it much smaller than the time constant of first capacitor 26. The value of second capacitor 28 has been chosen to enable it to charge and discharge in time to respond to the sequence of short HF voltage pulses impressed by the external signalling device during the programming period $t_1$–$t_2$ as shown in FIG. 4. In contradestinction the capacitance value and time constant of the first capacitor 26 has been chosen so that the high frequency encoding pulses marked A, B, C and D in FIG. 2 have only a negligible effect, as indicated by dotted line E, on the residual voltage remaining on first capacitor 26 during the programming period $t_1$–$t_2$. The time constant of first capacitor 26 has been selected so that the voltage remains above a value V min. over the programming period $t_1$–$t_2$ in order to sustain power for the circuit during this period. The essentially square wave pulse output from second rectifier 20 and second capacitor 28 is applied to the input of flip-flop 30 via electrical conductor 44, to a first input terminal of "and" gate 32 via electrical conductor 46, and to an input "clock" terminal "$C_K$" of counter 38 via electrical conductor 48. Initially flip-flop 30 is in a reset condition generating a relatively low voltage at its output. At time $T_1$, flip-flop 30 responds to the sharp negative rate of voltage change, due to discharge of second capacitor 28, by causing flip-flop 30 to switch to a high voltage state. Flip-flop 30 remains in its set state independent of any subsequent changes of voltage on second capacitor 28, as illustrated in period $t_1$–$t_2$ on FIG. 5, as long as the voltage on first capacitor remains above the V min value. The output of flip-flop 30 is electrically connected to a "clear" input terminal $C_L$ of counter 38 via electrical conductor 50 and to a second input terminal of "and" gate 32 via electrical conductor 52. The high voltage state of flip-flop 30 enables counter 38 and "and" gate 32 permitting pulses rectified by second rectifier 20, during period $t_1$–$t_2$ as shown in FIG. 4 to be passed through "and" gate 32 via lead 54 to a first input terminal of comparator member 36. A second input terminal of comparator 36 is electrically connected to the output of voltage reference member 34 by electrical conductor 56. Each arriving pulse during the programming period $t_1$–$t_2$ advances the counter 38 by one bit, and also is compared by the comparator 36 with the voltage reference member 34. As shown in FIG. 4, when the amplitude of the encoding pulse is higher than the voltage reference member 34 output voltage, the comparator output goes into a high state enabling the normally disabled gates 40 through a second input terminal via electrical conductor 58. Each of the programming pulses A, B C, D applied to the input of counter 38 results in a sequence of pulses at the plurality of output terminals of counter 38, shown graphically on FIG. 6, labeled A′ B′ C′, D′. The output of counter 38 is electrically connected to a plurality of first input terminals of the normally disabled gates 40 by electrical conductors 60, 62, 64 and 66. Since the pulses A, B, C, D are also applied to the comparator 36, there is a simultaneous arrival of a pulse to the input of the comparator 36 and to the input of the counter 38. The function of the comparator 36 is to selectively enable the normally disabled gates 40 when only a high level pulse, as represented by A″, C″ on FIG. 4, appears at the output of second rectifier 20. The outputs of the normally disabled gates 40 are electrically connected to a plurality of the input of a buffer-core driver circuit 42 by electrical conductors 68, 70, 72 and 74. The combined function of the counter 38 and the comparator 36 insures the storing of the high amplitude pulses in their proper position. The high amplitude pulses A″, C″ in this example are amplified by the buffer-core driver circuit 42 and electrically coupled to the appropriate "write" windings 76 and 80 of the core memory shown graphically by dash line 84. The write windings 78 and 82 in this instance would not be energized. The recording in the memory 84 of the rectified pulse A″, C″ will correspond to the generation of number 5 by the addition of numbers 1 and 4 as shown by the plot of the encoding pulses, in FIG. 2 generated by the normally disabled gate member 40. Any number up to 15 can be generated by a four bit sequence, thus enabling single information from 0 to 15 to be stored in the memory 84. Upon completion of the programming sequence at $t_2$, the voltage on the first capacitor 26 decays below the V min value, as shown on FIG. 3, the system 14 will become deenergized, with the encoded information permanently stored in the core of the memory 84. The information can be subsequently retrieved at terminals Y of the memory 84 by an interrogating pulse applied to the parallel connected interrogate winding 86, 88, 90 and 92 at interogate terminals 94 and 96. The memory 84 can be reprogrammed after erasing the existing contents. The cores can be demagnetized by impressing a gradually decaying wave train, as shown in FIG. 8, upon the memory erase windings 98, 100, 102 and 104 at erase terminal 106.

In operation, prior to launch of the munition the memory 84 is encoded as aforedescribed in a binary decimal code. Upon deployment, spin induced in the munition 10 by a launching mechanism, not shown, causes a normally open spin switch 108 to close permitting a short HF arming pulse from the external signaling source to activate an internal energy source 110. This arming pulse is of sufficiently short duration to cause no significant effect on the programming circuitry, but is sufficient to activate a passive squib initiated internal power source 110. The output of the internal power source 110 is electrically connected to a start circuit of timer 112. Timer 112 after being initiated by the internal power source 110 generates an interrogate pulse, after a specifically set interval. The interrogate pulse is applied to the interrogate terminals 94 and 96 of memory 84 via electrical conductors 114 and 116 respectively. The interrogate pulse causes the memory to transfer the encoded information contained therein to memory output terminals Y which are in turn electrically connected to the timer input terminals Y′. The timer now set with the encoded information transferred from the memory 84 will after a given interval of time generate a self destruct signal at timer output terminal 118 which will explode munition 10.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the United States is:

1. A device for electromagnetically encoding prior to launch an energy passive munition to self destruct after deployment in accordance with stored instructions which comprises:

a secondary receiving coil proximately positioned adjacent to an interior wall of said munition, for receiving signals from a high frequency external energy source;

first rectifier-capacitor means electrically coupled to said secondary receiving coil for energizing said device during a charging period;

second rectifier-capacitor means electrically coupled to said secondary receiving coil, for generating substantially square wave encoding pulse signals in response to high frequency programming pulses for said external energy source;

logic circuitry means electrically connected to said second rectifier-capacitor means adapted for generating binary coded output signals in response to said substantially square wave encoding pulse signals received from said second rectifier-capacitor means;

memory means electrically coupled to said logic circuitry means for storing said binary coded output signals of said logic circuitry means and for transferring said binary coded output signals to memory output terminals upon receipt of an interrogate pulse at memory interrogate terminals;

timer means for initiating said interrogate pulse upon deployment of said munition and for generating a self destruct signal to explode said munition in accordance with encoded information transferred from said memory means to said timer means;

acceleration responsive switch means, electrically coupled to said secondary, receiving coil for closing an electrical circuit upon deployment of said munition; and passive squib initiated internal power source means electrically connected in series with said acceleration responsive switch means and said timer means, for generating energy in response to receipt of a relatively short high frequency arming pulse after deployment of said munition from said secondary receiving coil, said internal power source means being adapted to start said timer means.

2. A device as recited in claim 1 wherein said first rectifier-capacitor means includes a first capacitor having a relatively longer time constant than said second rectifier-capacitor means.

3. A device as recited in claim 2 wherein said second rectifier-capacitor means includes a second capacitor having a relatively shorter time constant than said first capacitor of said first rectifier-capacitor means.

4. A device as recited in claim 3 wherein said logic circuitry means includes:

a flip-flop electrically coupled to and energized by said first rectifier-capacitor means, having an input terminal electrically coupled to the output of said rectifier-capacitor means and an output terminal, said flip-flop being initially in a reset condition generating relatively low voltage at said output terminal;

an "And" gate having a first input terminal electrically coupled to said second rectifier-capacitor means a second input terminal electrically connected to the output terminal of said flip-flop, said "And" gate being electrically coupled to and energized by said first rectifier-capacitor means;

a comparator member, electrically coupled to and energized by said first rectifier-capacitor means, having a first input terminal electrically coupled to the output of said "And" gate and a second input terminal;

a voltage reference member, electrically connected to and energized by said first rectifier-capacitor means, said second input terminal of said comparator member being electrically coupled to the output of said voltage reference member;

counter means electrically connected to and energized by said first rectifier-capacitor means having a "clear" input terminal electrically coupled to the output of said flip-flop, an input clock terminal electrically connected to the output of said second rectifier-capacitor means, and a plurality of output terminals;

normally disabled gate means, electrically connected to and energized by said first rectifier-capacitor means, having a plurality of first input terminals electrically connected to said plurality of contour means output terminals, a second input terminal electrically coupled to the output of said comparator member; and buffer core driver means having inputs electrically coupled to the outputs of said normally disabled gate means, for amplifying said binary coded output signals and for driving said memory means.

5. A device as recited in claim 4 wherein said acceleration responsive switch means includes means for operatively closing a switch in response to the spin of said munition.

* * * * *